US009004724B2

(12) United States Patent
Gao

(10) Patent No.: US 9,004,724 B2
(45) Date of Patent: Apr. 14, 2015

(54) REFLECTOR (OPTICS) USED IN LED DECO LAMP

(75) Inventor: Honglei Gao, ShangHai (CN)

(73) Assignee: GE Lighting Solutions, LLC, Cleveland, OH (US)

( * ) Notice: Subject to any disclaimer, the term of this patent is extended or adjusted under 35 U.S.C. 154(b) by 211 days.

(21) Appl. No.: 13/052,646

(22) Filed: Mar. 21, 2011

(65) Prior Publication Data

US 2012/0243235 A1 Sep. 27, 2012

(51) Int. Cl.

| | |
|---|---|
| ***F21V 7/04*** | (2006.01) |
| ***F21V 3/00*** | (2006.01) |
| ***F21V 7/22*** | (2006.01) |
| ***H01R 33/22*** | (2006.01) |
| ***F21K 99/00*** | (2010.01) |
| ***F21V 7/00*** | (2006.01) |
| *F21V 13/12* | (2006.01) |
| *F21W 121/00* | (2006.01) |
| *F21Y 101/02* | (2006.01) |

(52) U.S. Cl.

CPC . *F21V 3/00* (2013.01); *F21K 9/135* (2013.01); *F21K 9/50* (2013.01); *F21V 7/0066* (2013.01); *F21V 7/041* (2013.01); *F21V 7/04* (2013.01); *F21V 7/22* (2013.01); *F21V 13/12* (2013.01); *F21W 2121/00* (2013.01); *F21Y 2101/02* (2013.01)

(58) Field of Classification Search

CPC ..... F21K 9/10; F21K 9/13; F21K 9/135; F21K 9/1355; F21V 3/005; F21V 3/02; F21V 7/0008; F21V 13/02; F21V 29/2293; F21V 3/0418; F21V 3/0436; F21V 7/0066; F21V 7/046; F21V 7/05; F21V 7/048; F21V 7/04; F21V 7/09; H01L 33/60; F21Y 2101/02

USPC ..... 362/294, 373, 800, 187, 327, 329, 362/296.05, 307, 310, 328, 360, 361, 363, 362/650; 313/113–115

See application file for complete search history.

(56) References Cited

U.S. PATENT DOCUMENTS

| | | | | |
|---|---|---|---|---|
| 5,001,612 | A * | 3/1991 | Odlum | 362/187 |
| 6,218,785 | B1 * | 4/2001 | Incerti | 315/185 S |
| 6,361,192 | B1 | 3/2002 | Fussell et al. | |
| 6,759,803 | B2 | 7/2004 | Sorg | |
| 6,787,999 | B2 | 9/2004 | Stimac et al. | |

(Continued)

FOREIGN PATENT DOCUMENTS

| | | |
|---|---|---|
| CN | 101275731 A | 10/2008 |
| CN | 201414247 Y | 2/2010 |

(Continued)

OTHER PUBLICATIONS

PCT Search Report issued in connection with corresponding WO Patent Application No. CN2011/000073 filed on Jan. 18, 2011.

*Primary Examiner* — Alan Cariaso
(74) *Attorney, Agent, or Firm* — Fay Sharpe LLP

(57) ABSTRACT

In accordance with one aspect of the present disclosure, an LED decorative lamp is provided. The LED decorative lamp comprises a light engine having at least one LED mounted on a platform, a current regulated driver configured to provide power to the at least one LED, the driver mounted inside a base, a substantially hollow envelope forming an enclosure over the light engine and driver, and a reflector disposed above the light engine. The reflector is configured to improve the light distribution of the at least one LED.

17 Claims, 2 Drawing Sheets

(56) References Cited

U.S. PATENT DOCUMENTS

| | | | | |
|---|---|---|---|---|
| 6,866,401 | B2 | 3/2005 | Sommers et al. | |
| 7,204,606 | B2 | 4/2007 | Brass et al. | |
| 7,208,881 | B2 * | 4/2007 | Young | 315/224 |
| 7,275,841 | B2 * | 10/2007 | Kelly | 362/345 |
| 7,488,097 | B2 * | 2/2009 | Reisenauer et al. | 362/373 |
| 7,498,610 | B2 * | 3/2009 | Kim et al. | 257/99 |
| 7,521,872 | B2 * | 4/2009 | Bruning | 315/158 |
| 7,731,384 | B2 * | 6/2010 | Curran et al. | 362/184 |
| 7,772,604 | B2 | 8/2010 | Duong et al. | |
| 7,833,811 | B2 * | 11/2010 | Han et al. | 438/27 |
| 7,922,364 | B2 * | 4/2011 | Tessnow et al. | 362/294 |
| 8,011,808 | B2 * | 9/2011 | Liu | 362/294 |
| 8,125,127 | B2 * | 2/2012 | Mo et al. | 313/113 |
| 8,227,968 | B2 * | 7/2012 | Kaandorp et al. | 313/114 |
| 8,395,310 | B2 * | 3/2013 | Li | 313/498 |
| 8,596,830 | B2 * | 12/2013 | du Plessis | 362/296.1 |
| 2007/0267976 | A1 | 11/2007 | Bohler et al. | |
| 2010/0002432 | A1 * | 1/2010 | Romano | 362/235 |

FOREIGN PATENT DOCUMENTS

| | | | |
|---|---|---|---|
| CN | 201475754 | U | 5/2010 |
| CN | 201547552 | U | 8/2010 |
| CN | 201688213 | U | 12/2010 |
| KR | 10-2011-0000897 | A | 1/2011 |

* cited by examiner

REFLECTOR (OPTICS) USED IN LED DECO LAMP

CROSS REFERENCE TO RELATED APPLICATIONS

This application claims the priority benefit of PCT/CN2010/002225, filed Dec. 31, 2010, which is expressly incorporated herein by reference, in its entirety.

BACKGROUND

The following relates generally to illumination arts, lighting arts, solid state lighting arts, and related arts, and find particular application in conjunction with the use of reflectors in LED decorative lamps. However, it is to be appreciated that the present exemplary embodiments are amenable to other like applications.

Incandescent light bulbs are widely used in household and commercial lighting, for portable lighting, such as table lamps, car headlamps, and flashlights, and for decorative and advertising lighting. Incandescent lamps are generally omni-directional light sources capable of providing substantially uniform intensity distribution over a wide angle in the far field (greater than 1 meter away from the lamp) and find diverse applications such as in desk lamps, table lamps, decorative lamps, chandeliers, ceiling fixtures, and other applications where a uniform distribution of light in all directions is desired.

Incandescent light bulb packages include a light source comprising an incandescent filament within a glass enclosure. However, the incandescent filaments are fragile and tend to gradually degrade during a lifetime of a bulb causing the useful light output generated by the filaments to decrease over time. The increasing fragility of the filament with age eventually leads to breakage. Typical incandescent bulbs have a mean life of 500 to 4,000 hours.

Light emitting diodes (LEDs) are now being implemented as an attractive alternative light source in a light bulb package. A low-power, solid state LED light could last up to 100,000 hours (eleven years), far outlasting the life of a typical incandescent bulb. When the LED degrades to half of its original intensity after 100,000 hours, it continues operating with a diminished output. Even with this diminished output, LEDs are still ten times more energy efficient than incandescent bulbs, and about twice as efficient as fluorescent lamps. Besides producing little heat and being energy efficient, LEDs are solid-state devices with no moving parts. LED characteristics do not change significantly with age and they are not easily damaged by shock or vibration. This makes LED lighting systems very reliable. The small shape and low heat generation enables LED lighting systems to take on various shapes and sizes.

Widespread use of the LED lighting systems has been limited because the consumers are accustomed to seeing and purchasing the traditional incandescent bulb lights. The number of various incandescent light bulb packages on the market is tremendous. Particularly, decorative light bulbs are seen in various shapes, such as globe, candle, torpedo, prism, star, etc. to suit decorative requirements. Decorative incandescent bulbs are used in many different kinds of lighting applications including chandeliers, outdoor lighting, and many other types of indoor, outdoor, or special accent lighting.

One approach to making LED light bulbs more commercially attractive has been to directly retrofit the LED into the existing light package. LED devices have been developed with one or more light emitting diodes for emitting light. The diodes include a positive terminal and negative terminal for electrical conduction. The device further may include a lead frame electrically coupled to the positive and negative terminals of the diodes. The lead frame connects the diodes to an outer circuitry such as a power supply, such that when activated, the lead frame causes the diodes to emit light. The device may further comprise a light transmissive dome encapsulating the diodes.

As mentioned above, unlike an incandescent filament in traditional bulbs, an LED is an inherently directional light source, as they are a flat device emitting from only one side. However, LEDs can be modified with individual optics and may be arranged in a way to approximate the broader light distribution of an incandescent lamp. Lenses are also commonly used in decorative lighting applications to gather and control the light produced by the lamp.

Typically, polycarbonate ("PC") lenses are implemented to adjust the light distribution and obtain a larger beam angle. PC lenses comprise transparent or semi-transparent plastic material. Since PC has a high transmission and a relatively low cost, it is widely used to make low-cost lenses for LED products. The PC lens will create a larger beam angle; however, transmission loss is about 15-20%, resulting in a low lumen per watt (lm/W) of the LED decorative lamp system, such as only 35-45 lm/W. Accordingly, there is a need for a means of adjusting light distribution while minimizing transmission loss.

BRIEF SUMMARY

In accordance with one aspect of the present disclosure, an LED decorative lamp is provided. The LED decorative lamp comprises a light engine having at least one LED mounted on a platform, a current regulated driver configured to provide power to the at least one LED, the driver mounted inside a base, a substantially hollow envelope forming an enclosure over the light engine and driver, and a reflector disposed above the light engine. The reflector being configured to improve the light distribution of the at least one LED.

In accordance with another aspect of the present disclosure, an LED lamp is provided. The LED lamp comprises one or more LEDs disposed on a platform, a base connector configured to receive a driver and adapted to retrofit into a conventional incandescent light socket, a light transmissive enclosure removably attached to the base and enclosing the one or more LEDs in a substantially hollow space, and a reflector positioned over the one or more LEDs adapted to provide an efficiency of and improve light distribution.

In accordance with yet another aspect of the present disclosure, a method for improving an LED lamp's efficiency and light distribution is provided. The LED lamp comprises one or more LEDs disposed on a platform and a substantially hollow light transmissive enclosure over the one or more LEDs. The method comprises disposing a reflector over the one or more LEDs within the enclosure, the reflector being coated on at least one surface with a reflective material having a thickness, increasing the thickness to increase the percentage of reflected light, decreasing the thickness to increase the percentage of refracted light, and adjusting the distance of the reflector from the one or more LEDs for adjusting the beam angle.

BRIEF DESCRIPTION OF THE DRAWINGS

The invention may take form in various components and arrangements of components, and in various process operations and arrangements of process operations. The drawings are only for purposes of illustrating embodiments and are not to be construed as limiting the invention.

DETAILED DESCRIPTION OF PREFERRED EMBODIMENTS

Figure 1:
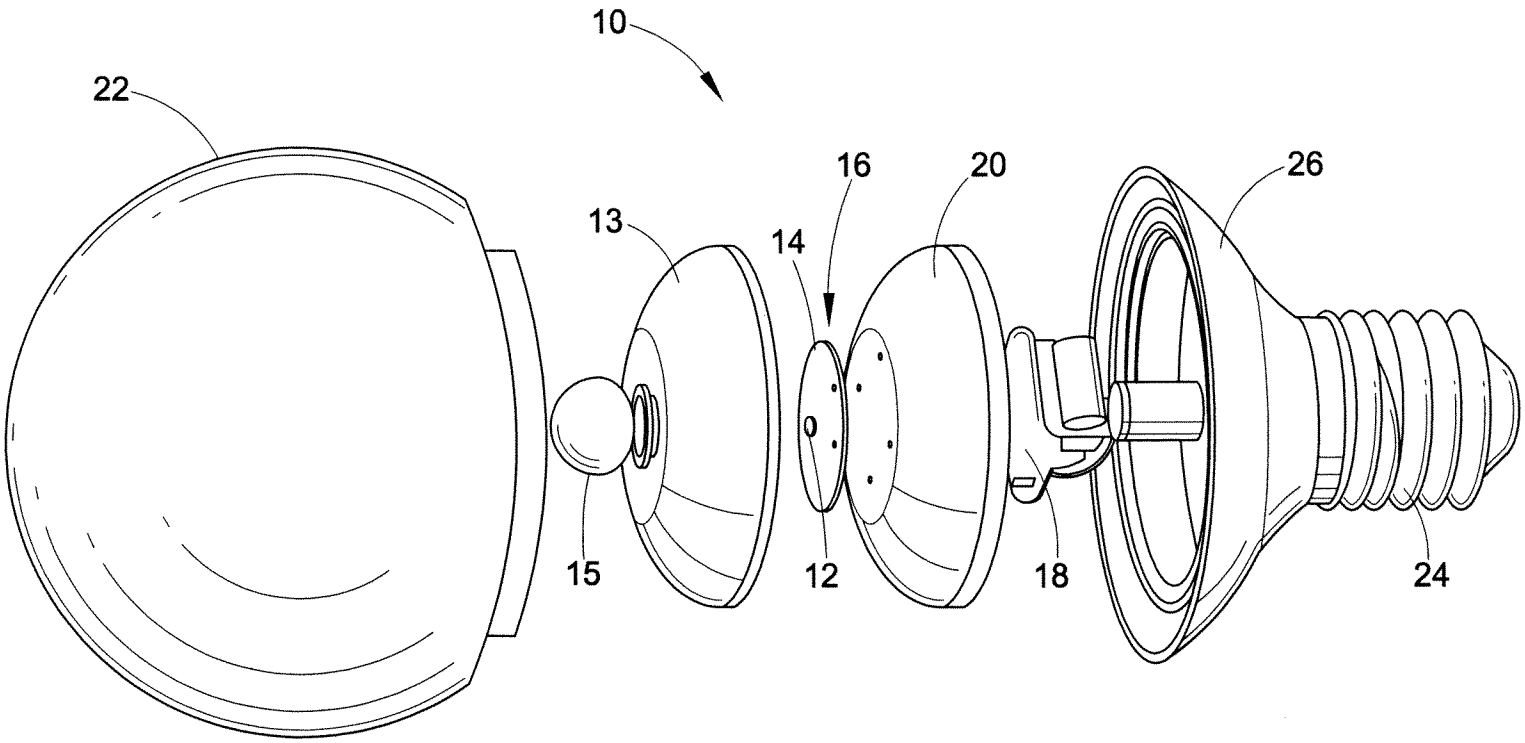
FIG. 1 (PRIOR ART)
FIG. 1 illustrates an exploded view of prior art LED decorative lamp including a polycarbonate lens.

With reference to FIG. 1, an exploded view of a typical LED decorative lamp 10 is provided that includes one or more LEDs 12 positioned on a platform 14, defining a light engine 16. A driver 18 is provided for powering the LEDs and is a self-contained power supply that is current regulated and may offer dimming by means of pulse width modulation circuits. The LED mounted platform 14 may be positioned directly on the driver 18 or a heat sink 20 may be included between the driver 18 and LED mounted platform 14. The LEDs 12 are one of inorganic and organic light emitting devices which emit light in a spectrum from UV to infrared. Variations in optical performance, viewing angles, and intensity levels are achieved by arranging the LEDs 12 in different patterns. The decorative lamp 10 includes a light cover or enclosure 22. The enclosure 22 may take on any shape desired or necessary for a particular decorative requirement. In the exemplary embodiment illustrated in FIG. 1, the enclosure 22 is globe-shaped. It is contemplated that the enclosure 22 can be spherical, elliptical, cylindrical, domed, squared, n-sided, or any other shape. Preferably, the enclosure 22 is built of light transparent or translucent materials, or a combination thereof. The enclosure materials are selected from glass, plastic, acrylic, polycarbonate, or other suitable materials.

Preferably, the platform 14 is a substrate on which a semiconductor may be grown. The platform 14 can be one of glass, sapphire, gallium arsenide, silicon carbide, gallium phosphorous, gallium arsenide, gallium nitride, or other suitable material. Preferably, the platform is FR-4 glass epoxy resin. It is also contemplated that the platform 14 can be a printed circuit board, heatsink 20, or any other suitable means for mounting the LEDs 12. The LEDs 12 are attached to the platform 14 by one of solder, wire bonding, thermosonic, thermo-compression, electrical conductive adhesives, thermal conductive adhesives, other suitable means, or a combination of the above. It is also contemplated that the LEDs 12 can be adjacent to or manufactured as an integral part of the enclosure 22.

The driver 18 is adapted to be directly mounted into a base or socket 24. In one embodiment, a base 24 has a receptacle into which the driver 18 is disposed. Preferably, the base 24 is one of the commercially available light bulb sockets for easy field exchange and retrofitting of the light bulb with the LED light engine such that the enclosure can be fitted over the light engine 16. For example, in one embodiment, the base 24 is one of commercially available incandescent light sockets such as 6S6 screw base, 194 wedge base, or other. Such design allows the conventional lamp to be replaced with a variety of different LED light engines without modification to the lamp socket or to the lamp enclosure. Optionally, the base is custom manufactured. The base 24 preferably includes a plastic or metal housing 26 extending from the base 24. The enclosure 22 is designed to be mounted on the base 24 by a snap-fit connection, a twist-on connection, and the like.

As mentioned above, a heatsink 20 may be included and in the LED light bulb. According to one embodiment, the heatsink 20 is integrally disposed in thermal communication with the light engine 16 and the base 24 to guide the heat away from the LEDs 12. The heatsink 20 is constructed from the material capable of conducting the heat away from the LEDs 12. Examples of suitable materials include copper, aluminum, silicon carbide, boron nitride and others known to have a high coefficient of thermal conductivity.

As indicated above, a clear PC lens is often provided in traditional LED decorative light bulbs to improve light distribution of the LED. As illustrated in FIG. 1, a PC lens 13 is included herein as a cover over the LED mounted platform. The lens 13 is generally a convex lens that curves outwardly into space enclosed by the enclosure away from the LED. Such an arrangement improves the angle of incidence, by an amount dependent on the radius of curvature of the surface of the lens. A portion 15 of the PC lens 13 surface may be coated with reflective material. Although the PC lens will improve light distribution of the LED decorative lamp, transmission loss can be about 15-20%, resulting in a low lumen per watt (lm/W) efficiency of the LED decorative lamp system, such as less than 35-45 lm/W.

Figure 2:
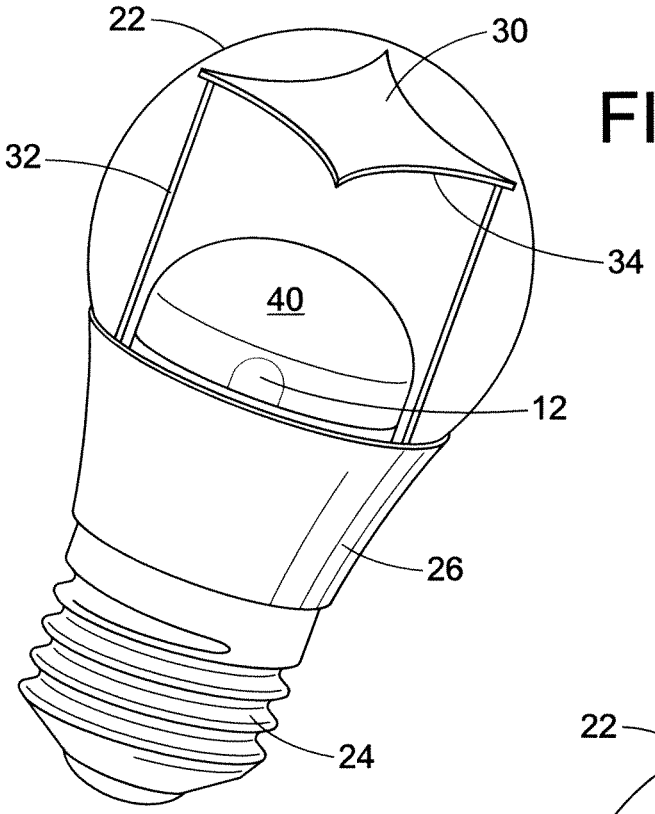
FIG. 2 illustrates one embodiment of an LED decorative lamp including a light distribution reflector.
Figure 3:
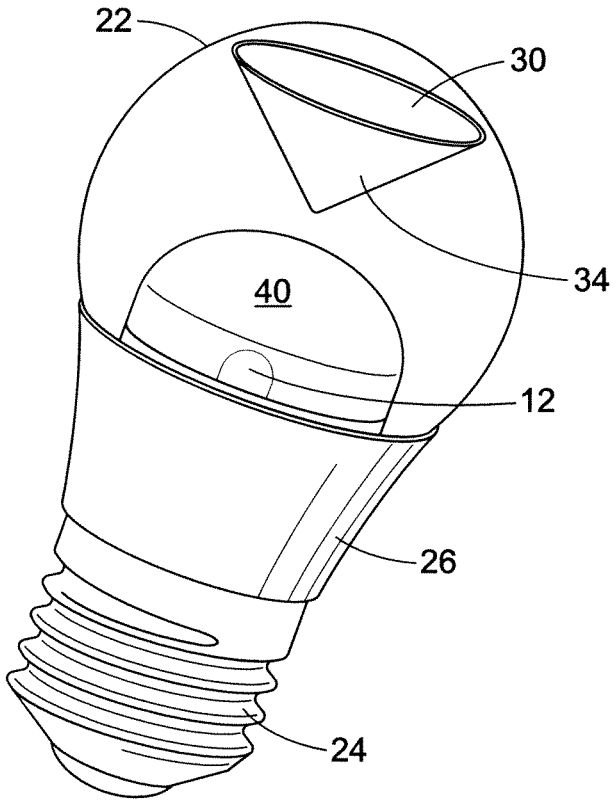
FIG. 3 illustrates another embodiment of an LED decorative lamp including a light distribution reflector.

The present disclosure provides a LED decorative lamp that provides improved light distribution of the LED while also reducing transmission loss. As illustrated in FIGS. 2 and 3, a reflector 30 is provided for changing and adjusting the light distribution of the LED. The reflector 30 is placed an adjustable distance above the LED, such that the reflector can be positioned closer to, or further from, the LED as needed. The reflector may include a reflective coating for reflecting light emitted by the light emitting diode. The reflective coating may comprise a metal, preferably silver, although other metals such as gold and aluminum may also be implemented. Preferably, the reflective coating is provided on at least one surface of the reflector, although providing the coating on both sides of the reflector is also contemplated herein. It is preferred that the reflective coating be provided on at least the inner surface of the reflector, facing the LEDs.

The thickness of the reflective coating is dependent on the desired lighting result. A thick coating on the reflector will reflect all the light that reaches the reflector from the LED to the back of the lamp, which increase the beam angle. However, when the reflective coating is thin, the reflector 30 will reflect only some of the light reaching the reflector 30 from the LED to the back of the lamp, thus only increasing the beam angle of a portion of the light. The light not reflected may be transmitted to the front of the lamp.

Referring specifically to FIG. 2, an LED decorative lamp is provided with reflector 30 attached to a lead frame 32 extending into the enclosure space. The reflector 30 is shown as comprising a generally square or diamond shape, having sides that curve inwardly and points extending outwardly to meet the enclosure 22 at four points; however, the reflector is not limited to this shape and may take any form desired and practical in a particular application, such as a generally rectangular, circular, and n-sided shape. The frame 32 extends past the LEDs into the enclosed space provided by the enclosure and supports the reflector. The frame 32 includes positive and negative supports that may be used to fix the reflector 30 in a position and maintain the reflector 30 a certain distance from the LED. Both the dimension of reflector and distance between the reflector 30 and LED has a large impact on the beam angle. The larger the reflector 30 and the smaller the distance from the reflector 30 to the LED, the more beam angle, and vice versa. The size of the reflector and distance of the reflector from the LED depends on a particular usage need. For instance, if a user requires light to reach around the entire lamp, similar to a chandelier, the size of the reflector will increase and the distance between the LED and the reflector will be shorter than usual. On the other hand, if the user requires the majority of light to remain to the front of the lamp and only some light to reach around to the backside of the lamp, the size of the reflector will lessen and the distance will increase. By adjusting the height of the lead frame supports, the distance of the reflector 30 from the LED can be adjusted as needed.

As further illustrated in FIG. 2, the reflector 30 includes a reflective coating 34 on the inside surface of the reflector, facing the LED. Preferably, the reflective coating comprises silver, although as stated above, other like materials may additionally or alternative implemented.

The LED decorative lamp may optionally include a PC cover 40 located inside the enclosure, covering the LED. The PC cover 40 is preferably semi-transparent such that the PC cover can change the light emitted from the LED and further increase the beam angle. Having a PC cover inside the outer enclosure provides further protection of the LED in the event the outer enclosure is broken. The PC cover 40 will also prevent customers from touching the inside of an LED, which is very hot and dangerous since the LED is connected to the driver. The PC cover 40 may take on any shape, such as a curve, sphere, globe, dome, cylinder, n-shaped, and elliptical.

FIG. 3 illustrates an alternative configuration of the LED decorative lamp, wherein the reflector 30 is included as an integral portion of the enclosure 22. In accordance with this configuration, no additional frame is necessary, as the reflector 34 is a part of the enclosure and does not include two separate pieces. As illustrated in FIG. 3, the reflector 30 comprises a conical shape with a circular top portion integral with the enclosure. The reflector 30 may further include a reflective coating 34 on one or more surfaces. According to the embodiment illustrated in FIG. 3, the reflective coating 34 is provided on the inside surface, facing the LED, although other configurations are also contemplated herein.

In either of the exemplary configurations of the present LED decorative lamp described above, the reflector is positioned farther from the LED then may be done with a typical lens; therefore, increasing the beam angle from about 120-150 degrees to about 270-320 degrees, such that the LED decorative lamp appears similar to an incandescent lamp. The transmission loss is only about 7% compared to the transmission loss of 20% seen with traditional PC lenses. This provides an improved lumens per watt over the about 35-38 lm/w seen with the PC lens. Energy Star qualification as an energy efficient device requires LED decorative lamps to achieve an efficiency level of about 40-45 lm/w and a beam angle of about 270 degree. The LED decorative lamp provided herein is configured to at a minimum meet each of these requirements, with an efficiency level of about 40-50 lm/w.

Modifications, alterations, and combinations will occur to others upon reading and understanding the preceding detailed description. It is intended that the invention be construed as including all such modifications and alterations insofar as they come within the scope of the appended claims or the equivalents thereof.

What is claimed is:

1. An LED lamp comprising a light engine having at least one LED mounted on a platform;

a current regulated driver configured to provide power to said at least one LED, said driver mounted inside a base;

a substantially hollow enclosure positioned to receive light from said at least one LED;

a semi-transparent cover covering the at least one LED and within the enclosure;

a reflector disposed above said light engine and spaced therefrom, said reflector having a first side facing the base and a second opposed side, said first side including a reflective coating, wherein said reflector is configured to modify the light distribution of the at least one LED; and a lead frame extending into said enclosure from the driver, wherein said lead frame supports said reflector and maintains the reflector an adjustable distance from said light engine.

2. The LED lamp of claim 1, wherein said LED further includes a heat sink positioned between said light engine and said driver.

3. The LED lamp of claim 1, wherein said enclosure comprises at least one of a spherical, globe, dome, cylindrical, n-sided, and elliptical shape.

4. The LED lamp of claim 1, wherein said reflector comprises one of a generally rectangular, square, diamond, square with sides that curve inwardly, and n-sided shape.

5. The LED lamp of claim 1, wherein said base is a screw base.

6. The LED lamp of claim 5, wherein said base is adapted to be retrofitted into a conventional incandescent light socket.

7. The LED lamp of claim 1, wherein said first side faces the at least one LED and said second side faces away from the LED.

8. The LED lamp of claim 7, wherein said reflective coating comprises at least one of silver, gold, and aluminum.

9. The LED lamp according to claim 1, wherein said reflector comprises a generally conical shape.

10. The LED lamp of claim 1, wherein said enclosure is substantially spherical.

11. The LED lamp of claim 1, wherein said reflector reflects a portion of the light distribution and transmits a portion of the light distribution.

12. The LED lamp of claim 1, wherein the reflector is square or diamond shaped.

13. The LED lamp of claim 12 wherein the reflector include sides that curve inwardly.

14. An LED lamp comprising:

at least one LED disposed on a platform;

a base connector configured to receive a driver, said base adapted to retrofit into a conventional incandescent light socket;

a light transmissive enclosure attached to said base and enclosing said at least one LED in a substantially hollow space;

a semi-transparent cover covering the at least one LED and within the enclosure; and a reflector positioned over said at least one LED, said reflector reflecting a portion of light emitted by said at least one LED and transmitting a portion of light emitted by the at least one LED, said reflector being adapted to provide an efficiency level of about 40-50 lm/w;

a lead frame extending into said enclosure from the driver, wherein said lead frame supports said reflector and maintains the reflector an adjustable distance from said light engine.

15. The LED lamp according to claim 14, wherein said reflector comprises a first side facing said at least one LED and a second side facing away from said at least one LED, wherein at least said first side is coated with a reflective coating.

16. The LED lamp according to claim 15, wherein said reflective coating comprises at least one of silver, aluminum, and gold.

17. The LED lamp of claim 14, wherein the reflector is square or diamond shaped and includes sides that that curve inwardly.

* * * * *